US005631680A

United States Patent [19]

Sugahara

[11] Patent Number: 5,631,680

[45] Date of Patent: May 20, 1997

[54] INK-EJECTING DEVICE AND METHOD OF MANUFACTURE

[75] Inventor: Hiroto Sugahara, Aichi-ken, Japan

[73] Assignee: Brother Kogyo Kabushiki Kaisha, Nagoya, Japan

[21] Appl. No.: 348,123

[22] Filed: Nov. 28, 1994

[30] Foreign Application Priority Data

Feb. 24, 1994 [JP] Japan ..... 6-026458

[51] Int. Cl.[6] ..... B41J 2/045

[52] U.S. Cl. ..... 347/69; 347/68

[58] Field of Search ..... 347/68, 69, 71, 347/94; 346/140.1, 140

[56] References Cited

U.S. PATENT DOCUMENTS

| | | | |
|---|---|---|---|
| 3,946,398 | 3/1976 | Kyser et al. | 346/1 |
| 4,723,129 | 2/1988 | Endo et al. | 346/1.1 |
| 4,879,568 | 11/1989 | Bartky et al. | 346/140 R |
| 5,016,028 | 5/1991 | Temple | 347/69 |
| 5,193,256 | 3/1993 | Ochiai et al. | 29/25.35 |
| 5,311,219 | 5/1994 | Ochiai et al. | 347/68 |
| 5,432,540 | 7/1995 | Hiraishi | 347/69 |

*Primary Examiner*—Benjamin R. Fuller
*Assistant Examiner*—Charlene Dickens
*Attorney, Agent, or Firm*—Oliff & Berridge

[57] ABSTRACT

An ink-ejecting device includes an actuator plate formed of piezoelectric material having ferroelectric properties, and a base plate formed of conductive material. After both plates are joined, plural grooves and partition walls for separating the grooves from one another are formed. First electrodes for applying a driving voltage are formed at respective size surfaces of the first grooves so as to extend from open portions of the grooves to middle portions thereof. The first electrodes are individually and independently connected to a controller. Further, second electrodes are formed on entire inner surfaces of respective second grooves, and all the second electrodes are connected to the controller through the base plate. According to an alternative embodiment, the ink-ejecting device further includes an intermediate plate formed of insulation material. After the three plates are joined, plural grooves and partition walls for separating the grooves from one another are formed. First electrodes for applying a driving voltage are formed on entire inner surfaces of respective first grooves, and the first electrodes are individually and independently connected to a controller. Further, second electrodes are formed on entire inner surfaces of respective second grooves, and all the second electrodes are connected to the controller through the base plate. A method of manufacturing an ink-ejecting device also is described.

15 Claims, 9 Drawing Sheets

INK-EJECTING DEVICE AND METHOD OF MANUFACTURE

CROSS-REFERENCE TO RELATED APPLICATION

The subject matter of this application is related to the subject matter of commonly assigned application Ser. No. 08/344,672, filed Nov. 21, 1994.

BACKGROUND OF THE INVENTION

1. Field of the Invention

The present invention relates to an ink-ejecting device and method of manufacture.

2. Description of Related Art

Non-impact-type printing devices have recently replaced conventional impact-type printing devices and have greatly propagated in the market. Ink-ejecting-type printing devices are known for simple operation and effective use in multi-gradation and coloration printing. Of these devices, drop-on-demand-type devices, which eject only ink droplets for printing, have propagated rapidly because of their excellent ejection efficiency and low operation cost.

A drop-on-demand device is disclosed in U.S. Pat. No. 3,946,398 to Kyser. A thermal-ejecting-type drop-on-demand device is disclosed in U.S. Pat. No. 4,723,129 to Endo. The former type is difficult to design in a compact size. The latter type requires ink having heat-resistance, because the ink is heated at high temperature. Accordingly, these devices are cumbersome to use and have many problems.

A shear-mode-type device, disclosed in U.S. Pat. No. 4,879,568 to Bartky et al., has been proposed to simultaneously solve the above problems.

As shown in FIGS. 9A and 9B, a shear-mode-type ink-ejecting device 600 as described above comprises a bottom wall 601, a ceiling wall 602 and a shear mode actuator wall 603 therebetween. The actuator wall 603 comprises a lower wall 607 that is adhesively attached to the bottom wall 601 and polarized in a direction as indicated by an arrow 611, and an upper wall 605 that is adhesively attached to the ceiling wall 602 and polarized in a direction as indicated by an arrow 609. A pair of actuator walls 603 thus formed forms an ink channel 613 therebetween, and a space 615 that is narrower than the ink channel 613 is formed between neighboring pairs of actuator walls 603.

A nozzle plate 617 having nozzles 618 formed therein is fixedly secured to one end of each ink channel 613, and electrodes 619 and 621 are provided as metallized layers on both side surfaces of each actuator wall 603. Each of the electrodes 619 and 621 is covered by an insulating layer (not shown) to insulate it from the ink. The electrodes 619, 621 that face the surface 615 are connected to the ground 623, and the electrodes that are provided in the ink channel 613 are connected to a silicon chip 625, which forms an actuator driving circuit.

Next, a manufacturing method for the ink-ejecting device 600 as described above will be described. First, a piezoelectric ceramic layer that is polarized in a direction as indicated by an arrow 611 is adhesively attached to the bottom wall 601, and a piezoelectric ceramic layer that is polarized in a direction as indicated by an arrow 609 is adhesively attached to the ceiling wall 602. The thickness of each piezoelectric ceramic layer is equal to the height of each of the lower wall 607 and the upper wall 605. Subsequently, parallel grooves are formed on the piezoelectric ceramic layers by rotating a diamond cutting disc or the like to form the lower wall 607 and the upper wall 605. Further, the electrode 619 is formed on the side surface of the lower wall 607 by a vacuum-deposition method, and the insulating layer as described above is provided onto the electrode 619. Likewise, the electrode 621 is provided on the side surface of the upper wall 605, and the insulating layer is further provided on the electrode 621.

The vertex portions of the upper wall 605 and the lower wall 607 are adhesively attached to one another to form the ink channels 613 and the spaces 615. Subsequently, the nozzle plate 617 having the nozzles 618 formed therein is adhesively attached to one end of the ink channels 613 and the spaces 615 so that the nozzles 618 face the ink channels 613. The other end of the ink channels 613 and the spaces 615 are connected to the silicon chip 625 and the ground 623.

A voltage is applied to the electrodes 619 and 621 of each ink channel 613 from the silicon chip 625, whereby each actuator wall 603 suffers a piezoelectric shear mode deflection in such a direction that the voluble of each ink channel 613 increases. The voltage application is stopped after a predetermined time elapses, and the volume of each ink channel 613 is restored from a volume-increased state to a natural state, so that the ink in the ink channels 613 is pressurized and ink droplets are ejected from the nozzles 618.

In the ink-ejecting device 600 as described above, the electrodes 619 and 621 that face the spaces (air channels) 615 are connected to the ground 623, and the electrodes 619 and 621 that are provided in the ink channels 613 are connected to silicon chip 625, which serves as an actuator driving circuit.

U.S. Pat. No. 4,879,568 fails to disclose a scheme or method for the above-described electrical connection. Therefore, for example, assuming the number of ink channels 613 to be fifty, fifty-one air channels 615 are required, and the electrical connection of the electrodes 619 and 621 must be performed at 101 connection positions. The connection positions are disposed at a narrow pitch, and thus it is difficult to form the connections and a long time is required to form the connections so that mass production is low.

SUMMARY OF THE INVENTION

An object of this invention is to provide an ink-ejecting device affording excellent mass production and allowing electrical connections to be formed easily.

To attain the above and other objects, an ink-ejecting device according to an embodiment of the invention includes an actuator member having plural grooves, a cover member for closing opening portions of the grooves of the actuator member, ink-ejecting channels that are formed by the grooves and the cover member and serve to eject ink, a non-ink-ejection channel that is provided at both sides of each of the ink-ejecting channels and ejects no ink, a conductive member constituting at least the bottom portions of the grooves that serve as the non-ink-ejecting areas, partition walls preferably of piezoelectric ceramic material that are provided on the conductive member so as to separate the grooves from one another and that are partially polarized, first electrodes that are formed on the partition walls of the side surfaces of the grooves serving as the plural non-ink-ejecting areas and electrically connected to the conductive member, and second electrodes that are formed on the partition walls of the side surfaces of the grooves serving as the plural ink-ejecting channels and are not electrically connected to the conductive member.

In the ink-ejecting device according to an embodiment of the present invention thus constructed, the conductive member constitutes at least the bottom portions of the grooves serving as the non-ink-ejecting areas, and the first electrodes are formed on the partition walls of the side surfaces of the grooves serving as the non-ink-ejecting areas and electrically connected to the conductive member, whereby all the first electrodes are electrically connected to one another through the conductive member, so that the conductive member serves as a common electrode, and the electrical connection of all the first electrodes to a controller can be performed at at least one position. Further, the second electrodes are formed on the partition walls of the side surfaces of the grooves serving as the ink-ejecting channels so that the second electrodes are not electrically connected to the conductive member.

As is apparent from the foregoing summary, according to one ink-ejecting device embodiment according to the present invention, the conductive member constitutes at least the bottom portion of the grooves serving as the non-ink-ejecting areas, the first electrodes are formed on the partition wall of the side surfaces of the grooves serving as the non-ink-ejecting areas and electrically connected to the conductive member, and the second electrodes are formed on the partition walls of the side surfaces of the grooves serving as the ink-ejecting channels so that the second electrodes are not electrically connected to the conductive member. Accordingly, the second electrodes are individually and electrically independently connected to the controller, and all the first electrodes are electrically connected to one another through the conductive member, so that the conductive member serves as a common electrode. Therefore, the electrical connection of all the first electrodes to the controller is performed at at least one position, and the number of electrical connections is reduced, so that the electrical connection to the controller is facilitated. Further, the electrical connection of the second electrodes to the controller is more facilitated because the pitch thereof is wider than that in the prior art. Therefore, the electrical connections are improved, and mass production of the devices is facilitated.

BRIEF DESCRIPTION OF THE DRAWINGS

Preferred embodiments according to the present invention will be described in detail with reference to the following figures wherein.

DETAILED DESCRIPTION OF PREFERRED EMBODIMENTS

Figure 1:
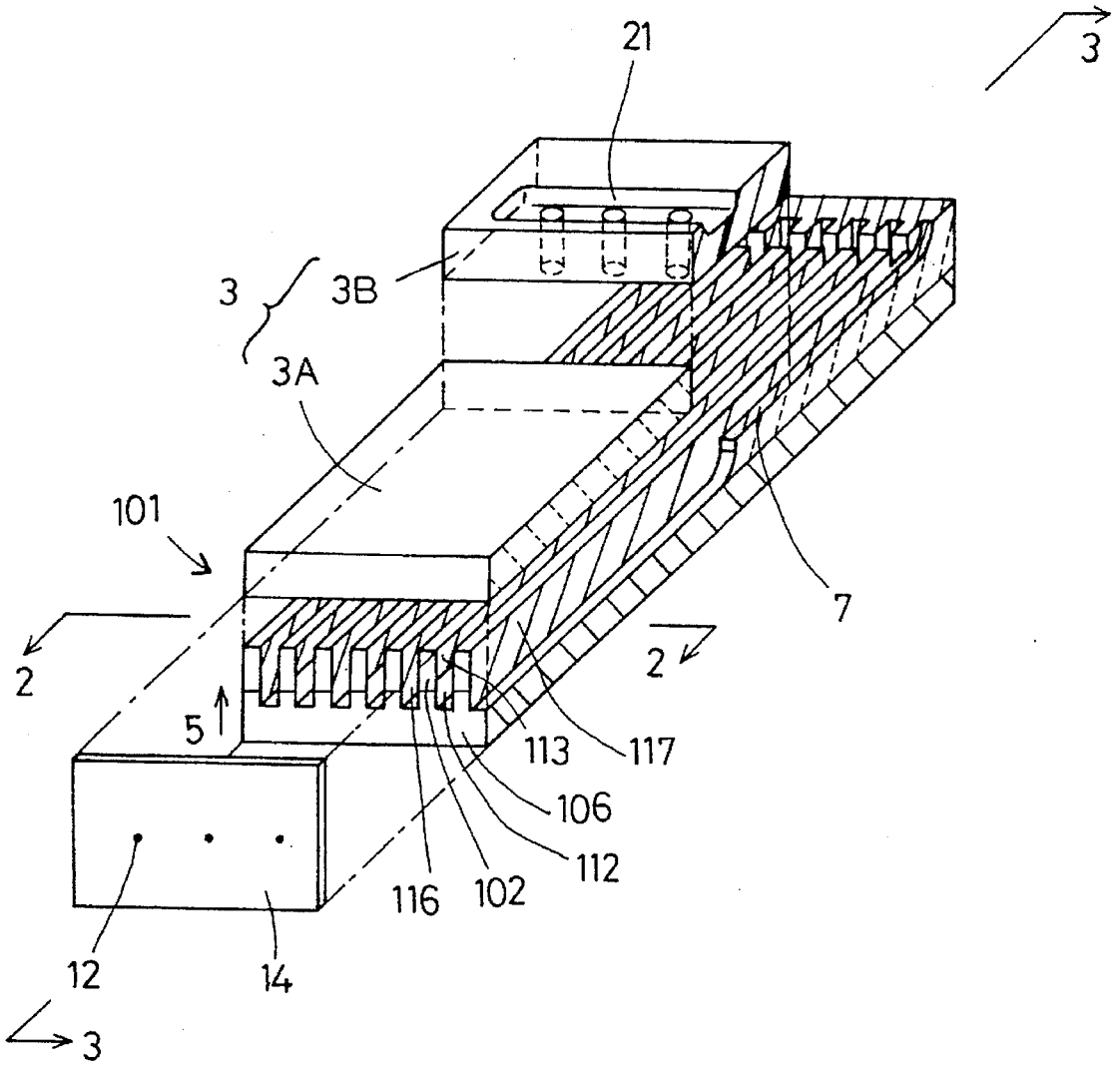
FIG. 1 is a perspective view showing an ink-ejecting device according to a first embodiment of the invention.
Figure 2:
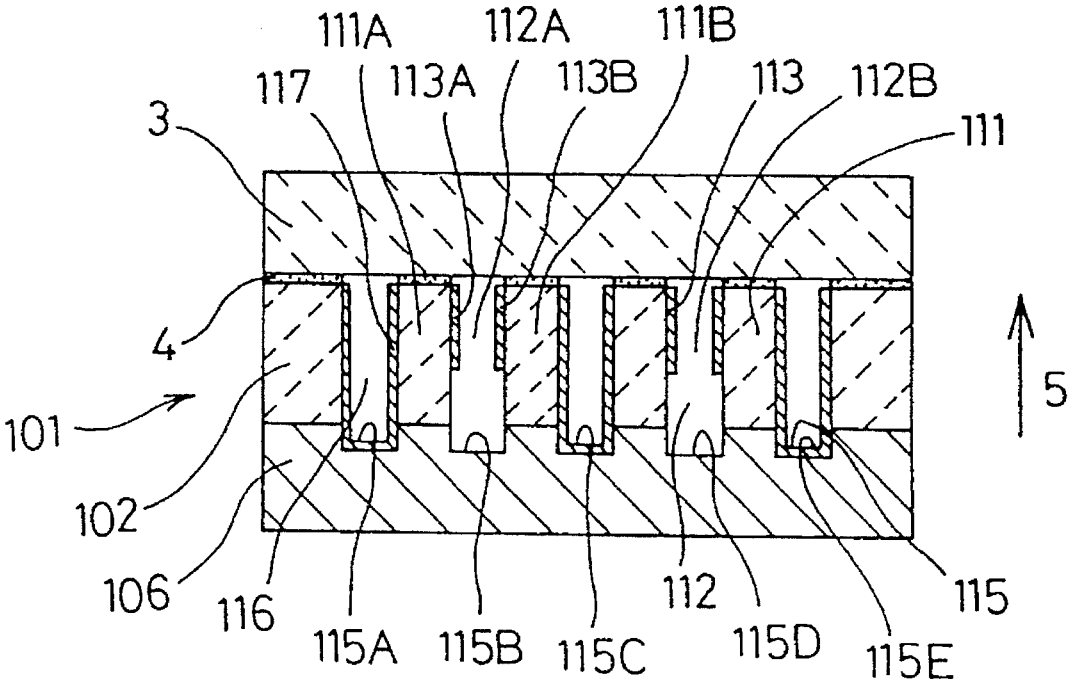
FIG. 2 is a cross-sectional view of the FIG. 1 ink-ejecting device, taken along line 2—2 of FIG. 1.
Figure 3:
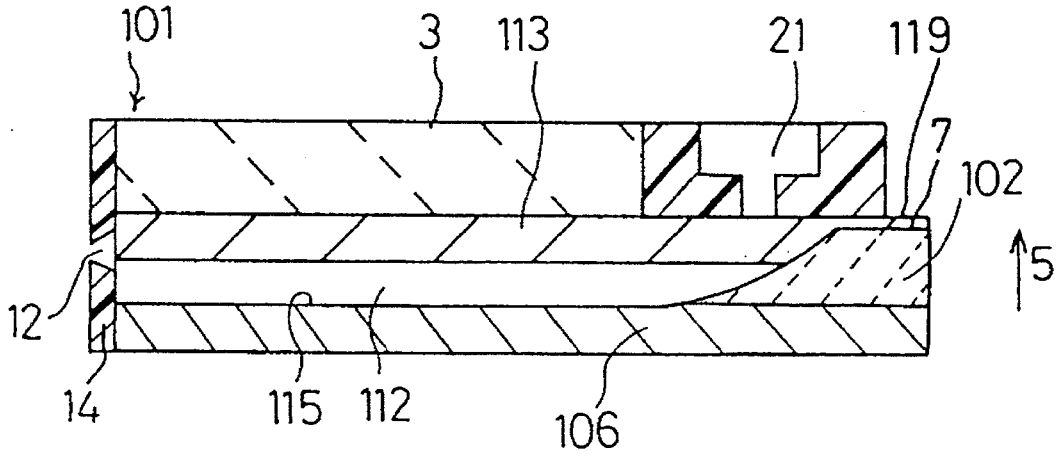
FIG. 3 is a cross-sectional view of the FIG. 1 ink-ejecting device taken along line 3—3 of FIG. 1.

Preferred embodiments according to the invention first will be described with reference to FIGS. 1 to 3. First, an ink-ejecting device 101 and a method of manufacturing the ink-ejecting device will be described with reference to FIGS. 1, 2, and 3.

The ink-ejecting device 101 comprises an actuator plate 102, a base plate 106, a cover plate 3 and a nozzle plate 14. The actuator plate 102 preferably is formed of piezoelectric material having ferroelectric properties, such as ceramic material of the lead zirconate titanate (PZT) group or the like. The base plate 106 preferably is formed of conductive material, for example, metal such as nickel, aluminum, copper or iron, cermet such as cemented carbide, carbon or the like. The actuator plate 102 and the base plate 106 are joined to each other preferably by an adhesive agent such as epoxy adhesive, diffused junction, integral sintering or the like, and then the actuator plate 102 is subjected to a polarization treatment in a direction indicated by an arrow 5.

Subsequently, the joint body of the actuator plate 102 and the base plate 106 is provided with plural grooves 115 and partition walls 111, through which the grooves 115 are separated, by cutting using a diamond blade or the like. The grooves 115 are of substantially the same depth and are in parallel to one another over substantially the whole area of the joint body of the actuator 102 and the base plate 106. The bottom portions of the grooves are formed by the base plate 106. Further, the grooves 115 are designed to become gradually shallower toward an end surface that is opposite to the nozzle plate side, and the grooves 115 in the neighborhood of the end surface comprise shallow grooves 7 whose bottom positions are not formed by the base plate 106.

Thereafter, electrodes 117 (also referred to as "first electrodes 117") are formed on the whole inner surfaces of odd-numbered grooves 115A, 115C and 115E, from the end of the joint body. These electrodes 117 on the inner surfaces of the grooves 115A, 115C and 115E are electrically connected to the base plate 106. That is, by setting the potential of the base plate 106, all the electrodes 117 are set to have zero potential. Further, electrodes 113 (also referred to as "second electrodes 113") are formed on the side surfaces of even-numbered grooves 115B and 115D so as to extend from the opening portions of the grooves to the middle portions of the side surfaces. In addition, electrodes 119 are formed on the side surfaces and bottom surfaces of the inner surfaces of the shallow grooves 7 by a sputtering method or other methods. Through this process, the electrodes formed on the partition walls 111 at both sides of the grooves 115B and 115D, for example, electrodes 113A and 113B of the groove 115B, are electrically connected to each other through the electrode 119 formed on the groove 7. Thereafter, an insulation layer (not shown) for insulating the ink and each electrode 113 from each other is formed on the electrode 113. To manufacture the device more easily, it is preferable that all the shallow grooves formed in the grooves 115A, 115C and 115E are provided with electrodes. Thus, electrodes 119 also are formed on these shallow grooves, although they are not actually used.

Thereafter, a cover plate 3 comprising a cover member 3A of ceramic material and a cover member 3B of resin material, the cover member 3B having ink supply holes 21 at positions corresponding to the grooves 115B and 115D, is joined to the joint body of the actuator plate 102 and the base plate 106, through a joint layer 4 preferably of an adhesive agent such as an epoxy adhesive agent or the like. The grooves 115B and 115D thus become plural ink channels 112 disposed at an interval in a lateral direction, and the grooves 115A, 115C and 115E become air channels 116 disposed so as to separate the ink channels 112 from one another. The ink channels 112 and the air channels 116 are designed in a slender form to have a rectangular cross-section, and the partition walls 111 extend over the whole length of the ink channels 112 and the air channels 116. Each ink channel 112 serves as an area filled with ink from an ink supply source (not shown) through the ink supply holes 21, and each air channel 116 serves as an area filled with air. The cover plate 3 is jointed such that the shallow grooves 7 are partially exposed to the outside, and the joint portion between the cover plate 3 and the shallow grooves 7 is provided with a non-conductive resin to prevent the ink from leaking from the shallow grooves 7.

Thereafter, the nozzle plate 14, which is provided with nozzles 12 at positions corresponding to the ink channels 112, is joined to the joint body of the actuator plate 102 and the base plate 106 and the end surface of the cover plate 3. The nozzle plate 14 preferably is formed of polyalkylene (for example, ethylene) terephthalate, polyimide, polyether imide, polyether ketone, polyether sulfone, polycarbonate, cellulose acetate or the like.

Figure 5:
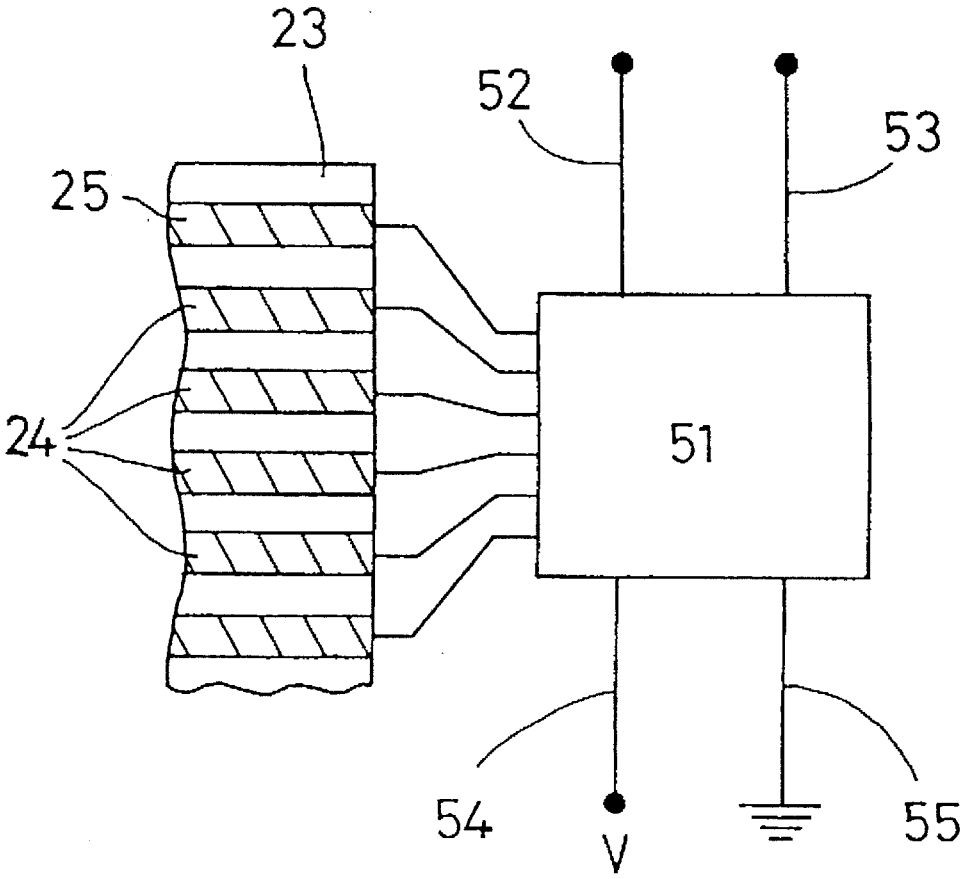
FIG. 5 is a block diagram showing a controller for the FIG. 1 ink-ejecting device.

Next, construction of the controller will be described with reference to FIG. 5, which is a circuit diagram of a preferred controller.

A conductive-layer pattern 24 on a flexible circuit 23 is connected to the electrodes 119 of the shallow grooves 7, and a pattern 25 is connected to the base plate 106. Each of the patterns 24 and 25 is individually connected to an LSI chip 51. A clock line 52, a data line 53, a voltage line 54 and a ground line 55 also are connected to the LSI chip 51. On the basis of a sequence of clock pulses supplied from the clock line 52, the LSI chip 51 identifies, from data appearing on the data line 53, a nozzle 12 through which an ink droplet should be ejected, and it applies a voltage V of the voltage line 54 to the conductive-layer pattern 24 that is conducted to the electrode 113 in an ink channel 112 to be driven (hereinafter referred to as the "target ink channel"). Further, the LSI chip connects the ground line 55 to portions of the conductive-layer pattern 24 that are connected to the electrodes 113 other than the electrode 113 of the target ink channel, and the pattern 25 that is conducted to the base plate 106.

Next, operation of the ink-ejecting device according to the first embodiment will be described.

Figure 4:
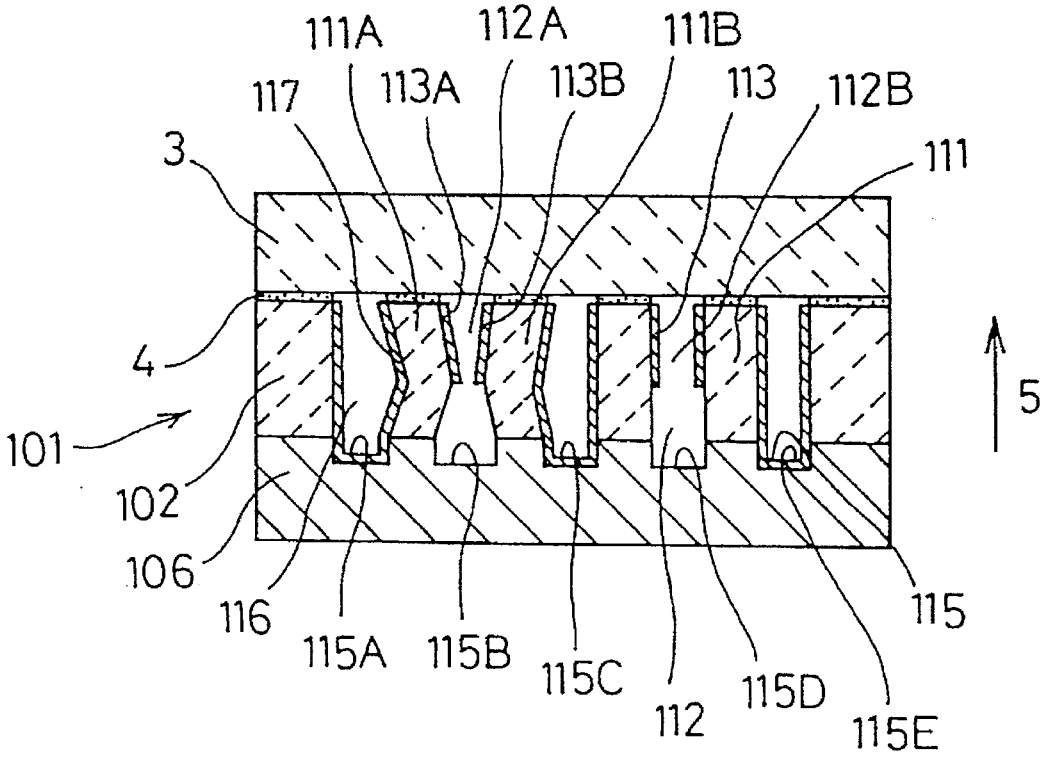
FIG. 4 is a diagram showing operation of the FIG. 1 ink-ejecting device.

In the ink-ejecting device shown in FIG. 4, when any ink channel, for example, an ink channel 112A, is selected in accordance with desired print data, a positive driving voltage is rapidly applied to the electrodes 113A and 113B by the controller, as described above. At this time, the base plate 106 is grounded, and thus the electrode is also grounded. Accordingly, a driving electric field acts on partition walls 111A and 111B, so that the partition walls 111A and 111B are rapidly deflected toward the inner side of the ink channel 112A in accordance with a piezoelectric thickness shear mode. Through this deflection, the volume of the ink channel 112A is reduced while the ink pressure of the ink channel 112A is rapidly increased, so that a pressure wave occurs and an ink droplet is ejected from the nozzle 12 intercommunicating with the ink channel 112A. After application of the driving voltage, the partition walls 111A and **111*b* return to their initial positions before deflection (FIG. 2), so that the ink pressure in the ink channel 112A is reduced and new ink is supplied from the ink supply source (not shown) through the ink supply hole 21 to the ink channel 112A**.

As described above, in the ink-ejecting device 101 according to the first embodiment, the electrodes 117 in all the air channels 116 are electrically connected to the base plate 106, so that all the electrodes 117 are maintained at zero potential by setting the potential of the base plate 106 to zero. Therefore, the electrical connection of the electrodes 117 of all the, air channels 116 to the ground can be performed at at least one position. Accordingly, the electrical connection to the controller can be by wire bonding or the like. For example, assuming the number of the ink channels 112 to be 50, the required number of the air channels 116 is 51. The electrical connection between the electrodes 113 and 117 and the controller can occur at 51 positions, that is, between the controller and the electrode 113 of each of the 50 ink channels 112, and between the base plate 106 and the controller, so that the electrical connections are improved and mass production is facilitated.

Next, a second embodiment according to the invention will be described. The same elements as in the first embodiment are represented by the same reference numerals, and a description of the same elements is omitted from the following description.

Figure 6:
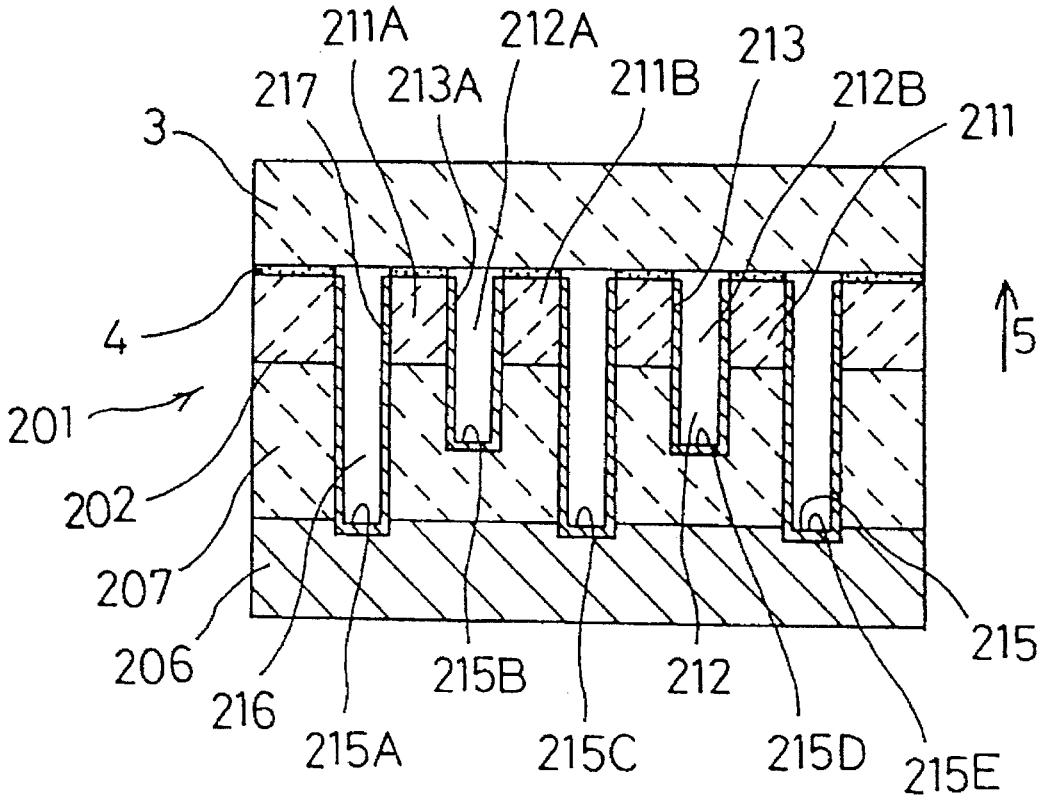
FIG. 6 is a cross-sectional view in a lateral direction of an ink-ejecting device according to a second embodiment.
Figure 7:
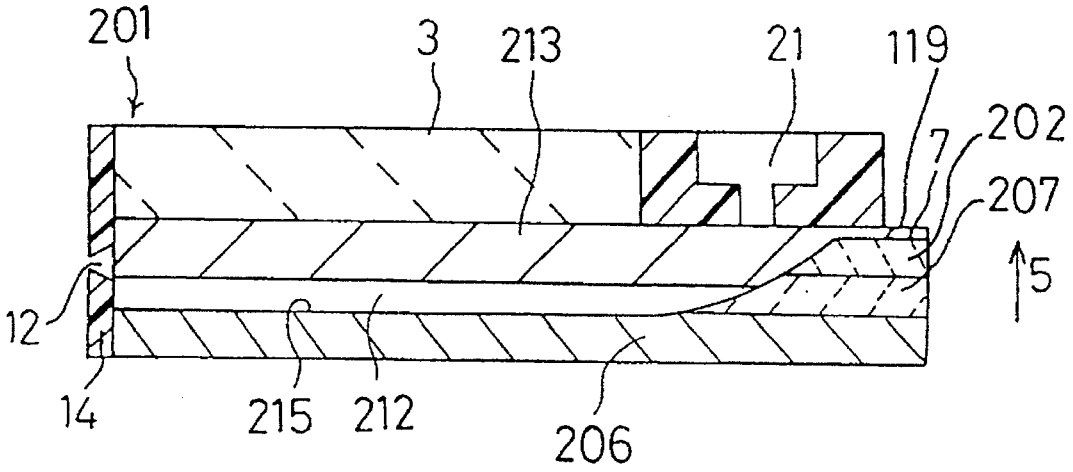
FIG. 7 is a cross-sectional view in a longitudinal direction of the FIG. 6 ink-ejecting device.

First, the construction of an ink-ejecting device 201 according to the second embodiment and a manufacturing method therefor will be described with reference to FIGS. 6 and 7. The ink-ejecting device 201 includes an actuator plate 202, an intermediate plate 207, a base plate 206, a cover plate 3 and a nozzle plate 14. The actuator plate 202 preferably is formed of piezoelectric ceramic material having ferroelectric properties, such as ceramic material of the lead zirconate titanate (PZT) group, for example. The intermediate plate 207 preferably is formed of insulating material such as ceramic material or resin material, and the base plate 206 preferably is formed of conductive material, for example, metal such as nickel, aluminum, copper or iron, cermet such as cemented carbide, carbon or the like. The actuator plate 202, the intermediate plate 207 and the base plate 206 are joined by an epoxy adhesive agent, diffused junction, integral sintering or the like, such that the intermediate plate 207 is joined with the base plate 206, and then the actuator plate 202 is joined with the intermediate plate 207. Thereafter, the actuator plate 202 is subjected to the polarization treatment in a direction as indicated by an arrow 5.

The joint body of the actuator 202, the intermediate plate 207 and the base plate are formed with plural grooves 215 and partition walls 211 from the side of the actuator plate 202 by cutting, using a diamond blade or the like. The odd-numbered grooves 215A, 215C and 215E from the end are deeper than the even-numbered grooves 215B and 215D from the end. Therefore, the bottom portions of the odd-numbered grooves 215A, 215C and 215E are formed by the base plate 206, and the bottom portions of the even-numbered grooves 215B and 215D are formed by the intermediate plate 207. With this construction, the partition walls 211 serving as the side surfaces of the grooves 215B and 215D are designed so That an upper portion thereof, for example an upper half area thereof, from the opening portion to the central portion is formed by the actuator plate 202 and a lower portion thereof, for example a lower half area thereof, is formed by the intermediate plate 207. Further, the grooves 215 are formed in parallel to one another substantially over the whole area of the joint body. However, the grooves 215 become gradually shallower toward the end surface that is opposite to a nozzle plate side, as described later, and the bottom portions of the grooves in the neighborhood of the end surface become shallow grooves 7, which are formed of the actuator plate 202 and disposed in parallel to one another.

Further, electrodes 217 are formed on the whole inner surfaces of the grooves 215A, 215C and 215E, whereby all the electrodes 217 on the inner surfaces of the grooves 215A, 215C and 215E are electrically connected to the base plate 206. That is, by setting the potential of the base plate 206 to zero, all the electrodes 217 are maintained at zero potential. Further, electrodes 213 are formed to apply a driving voltage to the whole inner surfaces of the grooves 215B and 215D. Electrodes 119 are further formed on the side surfaces and the bottom surfaces of the inner surfaces of the shallow grooves 7 by a sputtering method or other methods. Through this process, the electrodes formed on the partition walls 211 at both sides of the grooves 215B and 215D, for example, electrodes 213 in the groove 215B, are electrically connected to each other through the electrode 119 formed in the shallow groove 7. Further, an insulation layer (not shown) for insulating the ink and the electrodes 213 is formed over the electrodes 213. To manufacture the device more easily, it is preferable that all the shallow grooves formed in the grooves 215A, 215C and 215E are provided with electrodes. Thus, electrodes 119 also are formed on the shallow grooves although they are not actually used.

Subsequently, the joint body of the actuator plate 202, the intermediate plate 207 and the base plate 206 and the cover plate 3 are joined to each other by a joint layer 4 of an adhesive agent such as an epoxy adhesive agent. Through this process, the grooves 215B and 215D are plural ink channels 212 that are disposed at an interval in the lateral direction, and the grooves 215A, 215C and 215E are air channels 216 that are disposed so as to separate the ink channels 212 such as ink channels 212A and 212B from one another. The cover plate 3 is jointed so as to partially expose the shallow grooves 7 to the outside, and the joint portion between the cover plate 3 and the shallow grooves is provided with a non-conductive resin (not shown), thereby preventing leakage of the ink from the shallow grooves.

Thereafter, the nozzle plate 14, which is provided with nozzles 12 at positions corresponding to the ink channels 212, is joined to the joint body of the actuator plate 202, the intermediate plate 207 and the base plate 206 and the end surface of the cover plate 3. Subsequently, as with the first embodiment, the conductive-layer pattern 24 provided on the flexible circuit 23 shown in FIG. 5 is connected to the electrodes 119 of the shallow grooves 7 that intercommunicate with the electrodes 213 in the grooves 215B and 215D, and the pattern 25 is connected to the base plate 206. Each of the patterns 24 and 25 is individually connected to the LSI chip 51.

Next, the operation of the ink-ejecting device 201 according to the second embodiment will be described.

Figure 8:
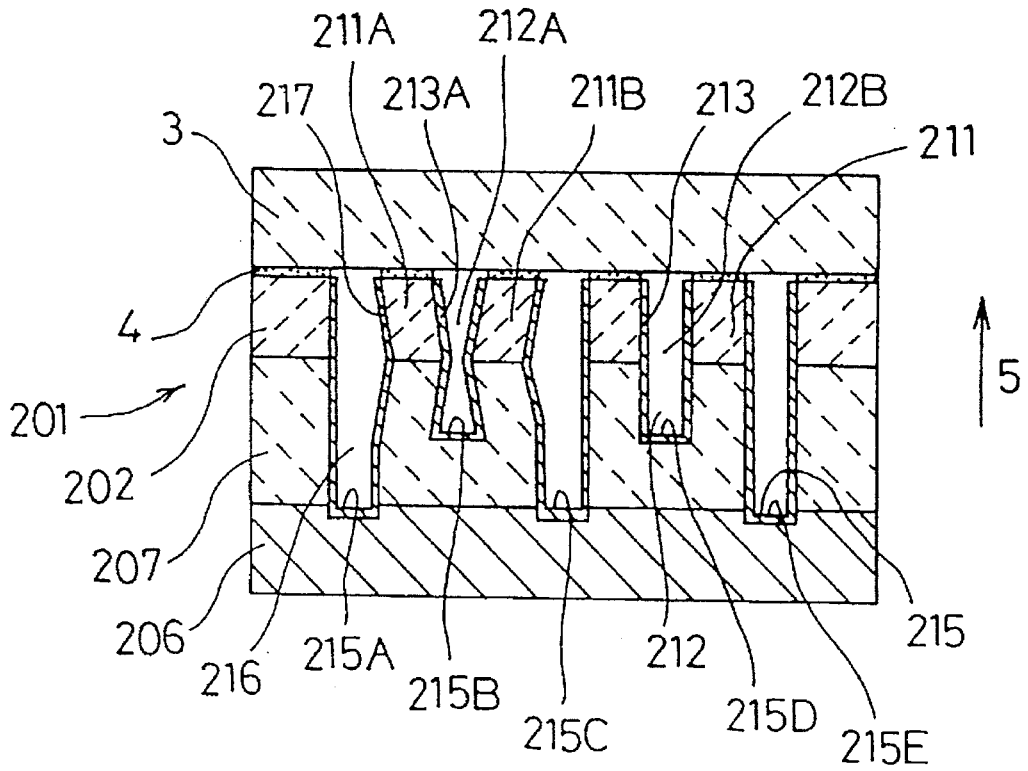
FIG. 8 is a diagram showing operation of the ink-ejecting device.
Figure 9A:
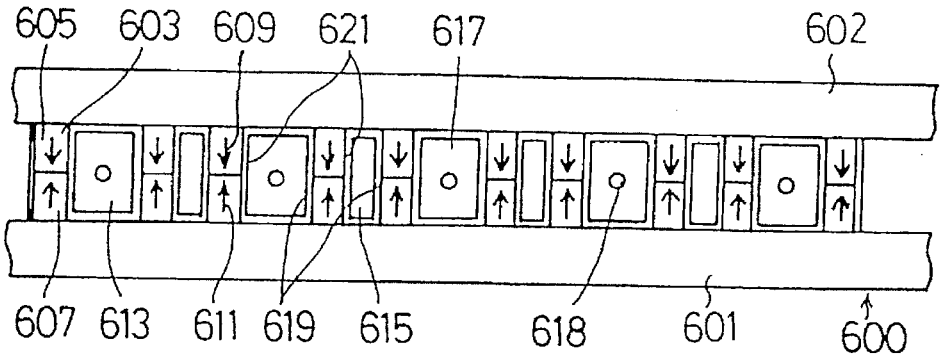
Fig.9 A PRIOR ART
FIG. 9A is a diagram showing a conventional ink-ejecting device.
Figure 9B:
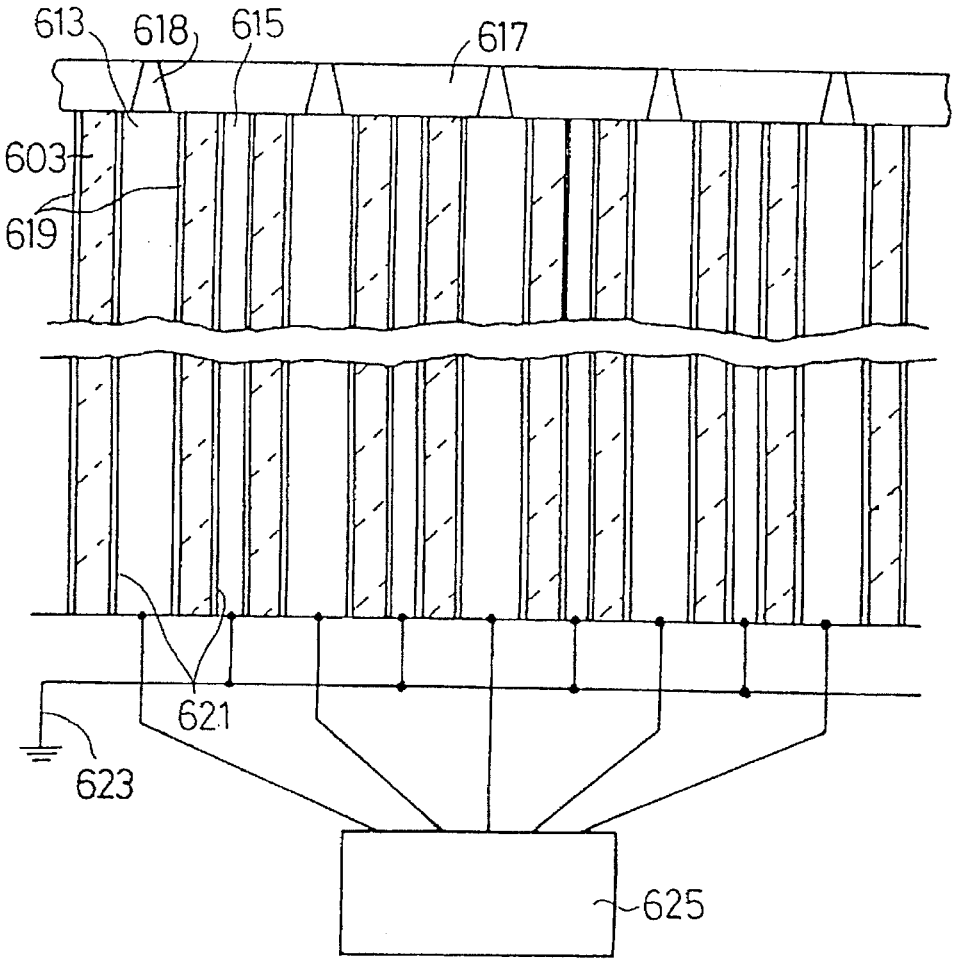
Fig.9 B PRIOR ART
FIG. 9B is a sectional plan view showing the FIG. 9A conventional ink-ejecting device.

In the ink-ejecting device shown in FIG. 8, for example when an ink channel 212A is selected in accordance with desired print data, a positive driving voltage is rapidly applied to the electrode 213A. At this time, the base plate 206 is grounded, and thus the electrodes 217 are also grounded. Accordingly, a driving electric field acts on the partition walls 211A and 211B, whereby portions of the actuator plate 202 that correspond to the partition walls 211A and 211B are deflected toward the inner side of the ink channel 212A in accordance with the piezoelectric thickness shear mode. This deflection causes the portions of the intermediate plate 207 corresponding to the partition walls 211A and 211B to be deflected toward the inner side of the ink channel 212A. Through this deflection, the volume of the ink channel 212A is reduced, and the ink pressure in the ink channel 212A is rapidly increased, so that a pressure wave occurs and an ink droplet is ejected from the nozzle that intercommunicates with the ink channel 212A. After application of the driving voltage, the partition walls 211A and 211B return to their initial positions before deflection, so that the ink pressure in the ink channel 212A is reduced and new ink is supplied from the ink supply source (not shown) through the ink supply hole 21 into the ink channel 212A.

As described above, in the ink-ejecting device 201 according to the second embodiment, all the electrodes 217 in the air channels 216 are electrically connected to the base plate 206. Therefore, by setting the potential of the base plate 206 to zero, all the electrodes 217 are maintained at zero potential, so that the electrical connection of the electrodes 217 of all the air channels 216 to the ground can be performed at least one position. Accordingly, the electrical connection to the controller using wire bonding or the like can be easily performed. For example, assuming the number of the ink channels 212 to be 50, the required number of the air channels 216 is 51. The electrical connection between the electrodes 213 and 217 and the controller can occur at 51 positions, that is, between the controller and the electrode 213 of each of the 50 ink channels 212, and between the base plate 206 and the controller, so that the electrical connections are improved and mass production is facilitated.

In the first and second embodiments, only two ink channels for ejecting ink are illustrated; however, the number of the ink channels may be 50, 100 or any number.

In the first and second embodiments, the driving voltage is applied so that the volume of the ink channels 112 and 212 is reduced to eject the ink droplet, and then the application of the driving voltage is stopped to return the ink channels 112 and 212 to their initial positions before deflection and to supply new ink into the ink channels 112 and 212. However, the driving voltage may be applied so that the volume of the ink channels 112 and 212 is increased to supply the ink into the ink channels 112 and 212, and then the application of the driving voltage is stopped to return the ink channels 112 and 212 to their initial positions before deflection to eject the ink.

Further, in the first and second embodiments, air channels 116 and 216 are filled with air; however, material having an elasticity smaller than the actuator plate 102, 202, for example, rubber, sponge, resin or the like, may be partially or fully filled in the air channels 116 and 216.

Still further, in the first and second embodiments, the cover plate 3 includes the cover member 3A formed of ceramic material and the cover member 3B formed of resin material. However, these members may be formed of the same material.

In the second embodiment, the intermediate plate 207 preferably is formed of insulating material, for example, ceramic material or resin material. However, it may be formed of piezoelectric material having ferroelectric properties and be polarized it the opposite direction to the polarization direction of the actuator plate 202, for example, ceramic material of the lead zirconate titanate (PZT) group.

Further, in the second embodiment, the intermediate plate 207 is joined with the base plate 206, and the actuator plate 202 is joined with the intermediate plate 207. However, the actuator plate 202 may be joined with the base plate 206 while the intermediate plate 207 is joined with the actuator plate 202. In such a case, reference numerals 202 and 207 in FIG. 6 would be reversed to represent, respectively, the intermediate plate and the actuator plate.

While advantageous embodiments have been chosen to illustrate the invention, it will be understood by those skilled in the art that various changes and modifications can be made therein without departing from the scope of the invention.

What is claimed is:

1. An ink droplet ejecting device, comprising:

an actuator member having a plurality of grooves with open portions;

a cover member for closing the open portions of said grooves of said actuator member;

a plurality of ink-ejecting channels being defined by alternating ones of said grooves and said cover member for ejecting ink droplets;

a plurality of air channels being defined by remaining ones of said grooves and said cover member;

a conductive member fabricated of an electrically conductive material and disposed at at least bottom portions of said grooves that in part define said air channels;

a plurality of partition walls connected with said conductive member to separate said alternating and remaining grooves from one another, said partition walls being formed of at least partially polarized material;

first electrodes formed on said partition walls that define side surfaces of said grooves that in part define said air channels, the first electrodes being connected to said conductive member; and second electrodes formed on said partition walls that define side surfaces of said grooves that in part define said ink-ejecting channels.

2. The ink droplet ejecting device according to claim 1, wherein said partition walls are formed of piezoelectric ceramic material, and said second electrodes are formed in a half of each alternating groove adjacent the open portion thereof.

3. The ink droplet ejecting device according to claim 2, wherein said first electrodes are formed on entire inner surfaces of said remaining ones of said grooves that in part define said air channels.

4. The ink droplet ejecting device according to claim 1, wherein one portion of each of said partition walls adjacent the open portion of each groove is formed of piezoelectric ceramic material, and another portion of each of said partition walls is formed of insulating material.

5. The ink droplet ejecting device according to claim 4, wherein said first electrodes are formed on entire inner surfaces of said remaining ones of said grooves that in part define said air channels.

6. The ink droplet ejecting device according to claim 4, wherein said grooves that in part define said plurality of air channels have a depth that is greater than a depth of said grooves that in part define said plurality of ink-ejecting channels.

7. The ink droplet ejecting device according to claim 4, wherein bottom portions of said ink-ejecting channels are formed of a member other than said conductive member, and said second electrodes are formed on entire inner surfaces of said alternating grooves that in part define said plurality of ink-ejecting channels.

8. The ink droplet ejecting device according to claim 1, wherein said partition walls are formed of piezoelectric ceramic material that is polarized in a first direction in portions thereof adjacent the open portions of said grooves and that is polarized in a direction opposite to the first direction in other portions thereof.

9. The ink droplet ejecting device according to claim 8, wherein said first electrodes are formed on entire inner surfaces of said remaining ones of said grooves that in part define said air channels.

10. The ink droplet ejecting device according to claim 8, wherein said remaining ones of said grooves that in part define said air channels have a depth that is greater than a depth of said alternating grooves that in part define said ink-ejecting channels, and wherein bottom portions of said air channels are formed of said conductive member.

11. The ink droplet ejecting device according to claim 8, wherein bottom portions of said ink-ejecting channels are formed of a member other than said conductive member, and wherein said second electrodes are formed on entire inner surfaces of said remaining ones of said grooves that in part define said air channels.

12. The ink droplet ejecting device according to claim 1, wherein said cover member is formed of two kinds of members, one of said members being provided with an ink supply hole through which ink is supplied to at least one of the ink-ejecting channels and being fabricated from a first material and the other member being fabricated from a second material different from the first material.

13. The ink droplet ejecting device according to claim 12, wherein said cover member comprises at least one plate.

14. The ink droplet ejecting device according to claim 1, further comprising a nozzle plate that includes nozzles at positions corresponding to said ink-ejecting channels.

15. A fluid droplet ejecting device, comprising:

ejecting means for ejecting fluid droplets, said ejecting means including alternating ones of a plurality of grooves;

air channels being defined by remaining ones of said grooves;

conductive means for conducting electricity, said conductive means being disposed at at least bottom portions of said remaining ones of said grooves that define said air channels;

first electrode means for providing electrical connection to the conductive means, the first electrode means being formed on side surfaces of said remaining ones of said grooves that define said air channels, the first electrode means being connected to the conductive means; and second electrode means for providing electrical connection to the ejecting means to eject fluid droplets.

* * * * *